US006989800B2

(12) United States Patent
McLaughlin

(10) Patent No.: US 6,989,800 B2
(45) Date of Patent: Jan. 24, 2006

(54) APPARATUS FOR MOUNTING AND ARRANGING A PLURALITY OF FLAT PANEL VIDEO DISPLAYS

(75) Inventor: William J. McLaughlin, Auburn, CA (US)

(73) Assignee: RGB Display Corporation, Grass Valley, CA (US)

( * ) Notice: Subject to any disclaimer, the term of this patent is extended or adjusted under 35 U.S.C. 154(b) by 309 days.

(21) Appl. No.: 10/209,783

(22) Filed: Jul. 30, 2002

(65) Prior Publication Data

US 2004/0021631 A1 Feb. 5, 2004

(51) Int. Cl.
*G09G 5/00* (2006.01)

(52) U.S. Cl. ..... 345/1.3; 345/1.1; 349/58; 348/383

(58) Field of Classification Search ..... 345/1.1, 345/1.3, 3.1, 3.2; 348/14.07, 383
See application file for complete search history.

(56) References Cited

U.S. PATENT DOCUMENTS 4,110,792 A * 8/1978 Long et al. ..... 348/383
4,583,309 A * 4/1986 Kane et al. ..... 40/711
4,669,697 A * 6/1987 Suzuki et al. ..... 248/638
4,919,287 A * 4/1990 Haskett et al. ..... 211/40
5,130,794 A * 7/1992 Ritchey ..... 348/39
5,299,017 A * 3/1994 Furuno ..... 348/786
5,767,818 A * 6/1998 Nishida ..... 345/1.1
5,805,117 A * 9/1998 Mazurek et al. ..... 345/1.3
6,054,968 A * 4/2000 De Matteo ..... 312/7.2
6,677,918 B2 * 1/2004 Yuhara et al. ..... 345/1.3

OTHER PUBLICATIONS

D.L. Peters, et al., "Digital Display Unit for CCTT", 1998 Image Conference, Aug. 1998 8 pages, Scottsdale, Arizona.

* cited by examiner

*Primary Examiner*—Dennis-Doon Chow
*Assistant Examiner*—Tom Sheng
(74) *Attorney, Agent, or Firm*—R. Michael West

(57) ABSTRACT

An apparatus for mounting and arranging a plurality of flat panel video display assemblies. An a arcuate receiver segment has a lower surface for attachment to a support and an upper surface for receiving a connection plate. A connection plate is attached to the bottom of each display assembly. The receiver segment includes a central registration pin about which an edge cutout on the connection plate is aligned. The base plate has two locking tabs in spaced relation on either side of the registration pin. Each display assembly is lowered over and rotated about the registration pin so that opposed edges of the connection plate slide into respective locking relation with the locking tabs. Ten receiver segments are arranged to form a circle for mounting ten video displays. Adjacent display assemblies are fastened together to form a mechanically secure and visually seamless display.

19 Claims, 5 Drawing Sheets

APPARATUS FOR MOUNTING AND ARRANGING A PLURALITY OF FLAT PANEL VIDEO DISPLAYS

BACKGROUND OF THE INVENTION

1. Field of the Invention

The invention relates generally to 360 degree video display systems, used in training or entertainment devices. More specifically, the invention pertains to an apparatus for mounting and arranging a plurality of flat panel video display assemblies, in which a plurality of arcuate receiver segments is arranged on a base plate to form a base ring, bottom edges of individual panels are lowered upon and rotated into locking engagement with a respective receiver segment, and adjacent panels are respectively attached to each other to form an inwardly directed circular array.

2. Description of the Prior Art

The prior art teaches the use of CRT display systems as visual aids in training devices or simulators. For example, air flight simulators used for pilot training, may use four to six CRTs installed in the cockpit "windows" of the simulator. Video information, corresponding to a prerecorded program as modified by the interaction of the student with that program, is displayed on the CRTs to simulate the visual experience of takeoff, flying, and landing procedures.

Similar arrangements have been used for other simulators, such as military tank trainers. However in this instance, the visual experience presented by the display must encompass 360 degrees, as opposed to the relatively narrow field of view presented by a flight simulator display. For the purpose of presenting a 360 degree visual display, the prior art teaches the use of five CRT assemblies, each including two CRTs, arranged to form a ring, with the light output of the CRT assemblies pointed inwardly toward the trainee. Each CRT assembly includes a downwardly directed, vertical CRT and a forwardly and inwardly directed, horizontal CRT. A computerized system feeds each CRT in the assembly with different video information, pertaining to physically contiguous fields of view. A beam splitter, interposed between the intersecting light outputs of the CRTs, redirects and reintegrates the visual information, so that a substantially seamless 72 degree field of view is presented to the viewer by each CRT assembly. The beam splitter does this by reflecting the light from the vertical CRT and by allowing throughput transmission of the light from the horizontal CRT.

CRTs have a number of drawbacks when used to simulate a circular 360 degree field of view, such as those used in a military tank trainer. CRTs are heavy and cumbersome to mount in the CRT assemblies which form a circular array. CRTs require a significant amount of room behind the CRT screen itself, to accommodate the rearwardly extending necks which house the electronic guns. Most of this room goes unused, resulting in a bulky and space inefficient arrangement. The computer system required to route and direct different video information to the CRTs is complex and expensive. The beam splitter used to redirect and reintegrate the visual outputs of the CRTs is also complex and expensive to manufacture. Lastly, CRTs in such applications are usually powered up continuously, and begin to lose light output and sharpness after a period of time as the electron guns and the phosphors degrade. Replacement of the CRTs is a labor intensive process, requiring down time when the training apparatus cannot be used.

Thus, the need exists for a video display replacement for the CRTs, which provides a high quality 360 degree image, and is also compact in size, lightweight, and easy to assemble and service.

The need further exists for an apparatus for mounting and arranging a plurality of flat panel video display assemblies, which can either be retrofitted to an existing training apparatus, or employed in a newly manufactured training apparatus, without modification.

The need also exists for a mounting and arranging system for a plurality of flat panel video display assemblies which allows an individual panel to be removed or replaced without disturbing the mounting or alignment of adjacent panels.

The need further exists for a mounting and arranging system for a plurality of flat panel video display assemblies in a circular array, in which the panels are self aligning, allowing the quick assembly, disassembly, and reassembly of the array without special tools or instruments.

SUMMARY OF THE INVENTION

The apparatus of the present invention employs a plurality of flat panel video display assemblies. Each video display assembly includes a display screen and a surrounding frame. The display screen is preferably an Active Matrix Liquid Crystal Display ("AMLCD"). The surrounding frame has a top plate, opposing, vertical side plates, and a bottom connection plate. The top plate includes a flange extending outwardly and horizontally from its left hand end, with a screw hole. The top plate has a similar flange extending from its right hand end, provided with a screw. The connection plate includes a centrally positioned cutout along an edge of a front flange. The cutout is used for alignment purposes during the installation of each panel.

The video display assemblies are mounted upon a circular base ring. The base ring is comprised often arcuate receiver segments. Each receiver segment spans a 36 degree arc, so that when ten receiver segments are arranged in abutting relation, the circular base ring is formed. Each receiver segment is dedicated to the support and alignment of a respective video display assembly. For that purpose, the upper surface of each receiver segment includes a pair of locking tabs equally spaced on either side of a centrally positioned registration pin.

The array is assembled by individually mounting each display assembly upon a respective receiver segment of the base ring, and then interconnecting top plates of adjacent display assemblies to each other. This is accomplished by initially lowering a first display assembly onto the upper surface of a receiver segment with the registration pin of the receiver segment nested within the cutout of the connection plate. At this point, the axes of the receiver segment and connection plate are askew, approximately 30 degrees or so. Maintaining the pin/cutout alignment, the display assembly is rotated about its vertical axis. Toward the end of this rotation of the display assembly, front and rear flanges of the connection plate slide underneath the locking tabs on the receiver segment until fully seated.

This process is repeated with the next display assembly. However this time, one top plate of the first display assembly comes into slightly overlapping relation with another top plate of the second display assembly, when the latter is rotated into its locking position. A screw in the top plate of the second display assembly is screwed into a respective hole in the top plate of the first display assembly. The slight overlap between the assemblies provides a nearly seamless match between adjacent display assemblies.

Successive display assemblies are mounted to the base ring and to each other in identical fashion, until the entire circular array is formed. The viewing area of each of the displays is directed inwardly, toward a center point of the array. Perfect angular alignment of the displays is ensured by the geometric configuration formed by the base ring which is mimicked by the array of display assemblies mounted thereon. The locking interconnections between the display assemblies and the receiver segments, coupled with the screw interconnections between adjacent assemblies, provide a rigid and accurately aligned array.

DETAILED DESCRIPTION OF THE PREFERRED EMBODIMENT

Figure 1:
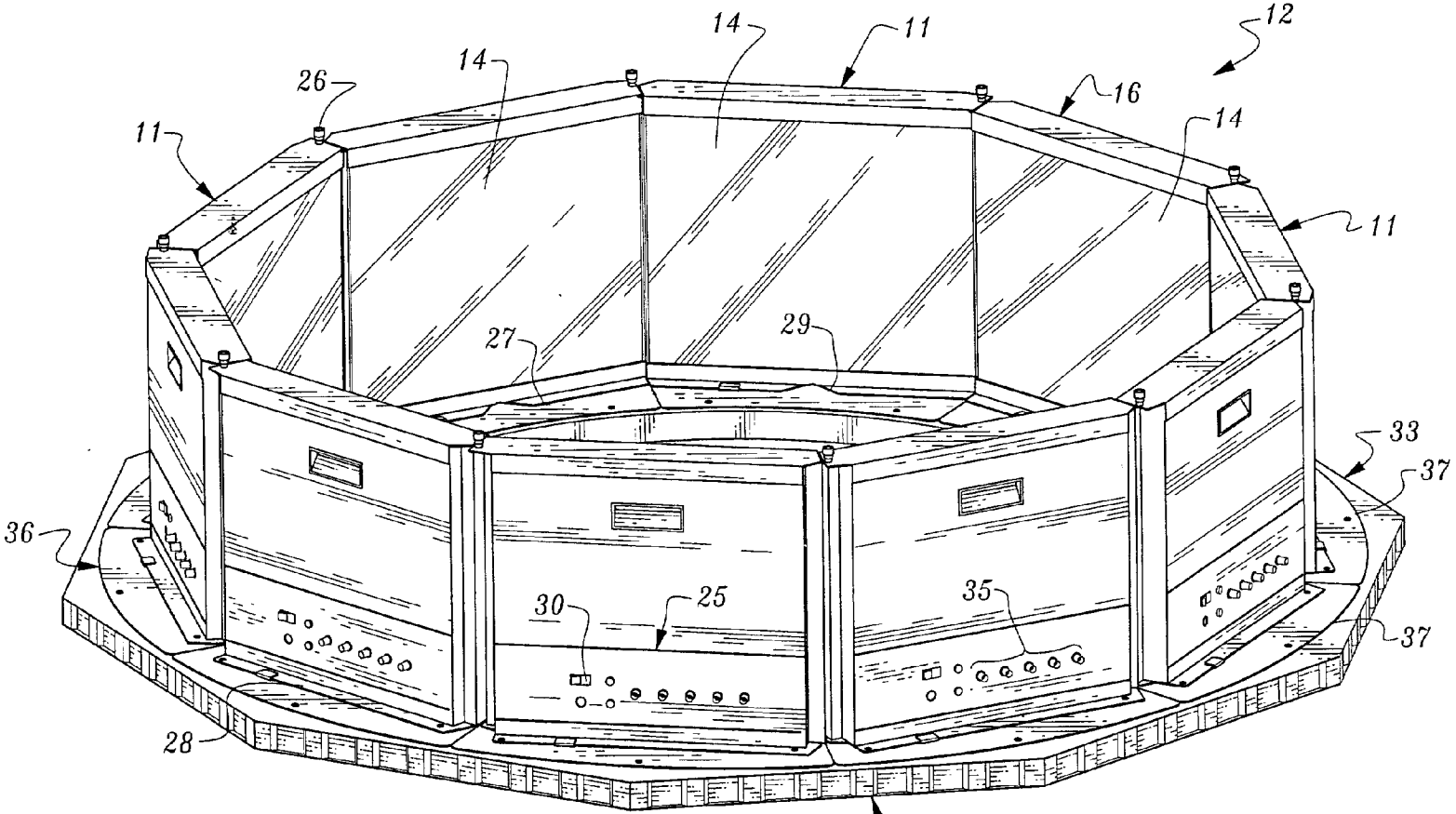
FIG. 1 is a perspective view of a plurality of flat panel video display assemblies arranged and assembled on a decagon base to form a circular array.

Turning now to the drawings, and in particular FIG. 1, ten flat video display panel assemblies 11 are arranged and assembled to form a generally circular array 12. The size of the array 12 is not critical, but in applications where the array is used as a video display for a tank training simulator, the diameter of the array is approximately four to five feet. This is large enough so that at least one person can comfortably operate within a large center aperture 13, surrounded by the array 12. (See, FIG. 7). The size of each display assembly for the typical training simulator will range from approximately twenty to twenty-five inches on the diagonal. For other applications, such as home or public theater displays, the number, size, and configuration of the display assemblies as well as the diameter of the array, may be quite different.

The display panel assembly 11 includes a flat display screen 14 provided with a surrounding frame 16. Preferably, screen 14 is of the type known as an Active Matrix Liquid Crystal Display (hereinafter, "AMLCD"). Modern AMLCDs have overcome two major faults which were characteristic of prior LCD display panels: (1) poor resolution; and, (2) slow turn-on/turn-off time, when compared to conventional Cathode Ray Tubes. With image resolution and pixel response time approaching or equaling that of CRTs, modern AMLCDs are now the display device of choice for many video display applications. However, the apparatus of the present invention may also be used in conjunction with other flat panel video display technologies, such as plasma and digital micro-mirror device ("DMD") displays. The AMLCD screen which has been used successfully by the inventor is the Model LTM213U3-L07,manufactured by Samsung Electronics, of Chonan, Korea.

Figure 4:
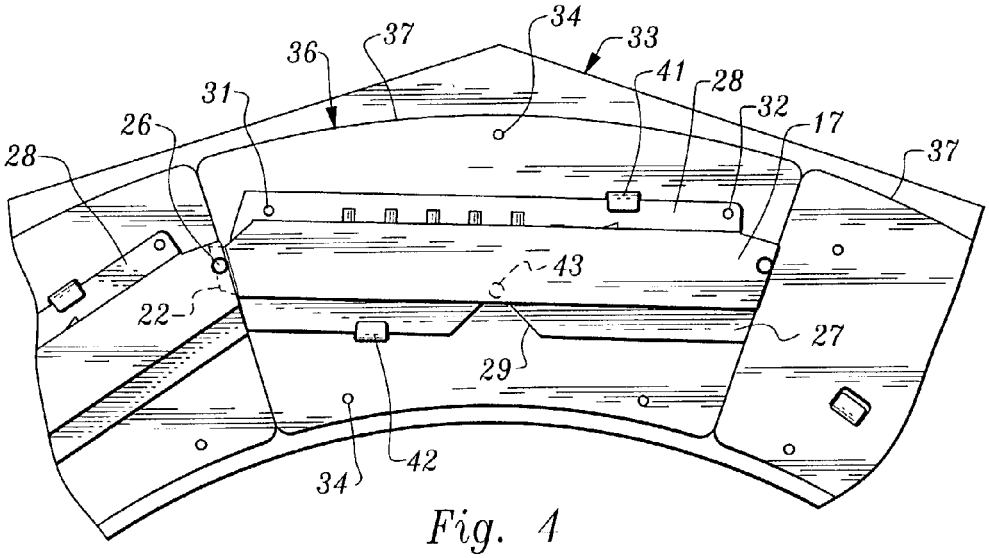
FIG. 4 is a top plan view of a first display assembly and a fragment of a second display assembly, fully installed on their respective receiver segments.

Surrounding frame 16 is comprised of a top plate 17, opposing, vertical side plates 18 and 19, and a bottom connection plate 21. The top plate 17 has first connection means including a first flange 22 extending outwardly from its left hand end. Flange 22 is provided with a screw hole 23. The top plate also has second connection means including a second flange 24 extending from its right hand end. Flange 24 is provided with a captive screw 26. The bottom connection plate 21 is perpendicular to screen 14 and includes a front flange 27 and a rear flange 28, extending, respectively, forwardly and rearwardly from the screen 14. Front flange 27 has a centrally positioned triangular-shaped cutout 29. The corner portions of rear flange 28 include upper registration holes 31 and 32. (See, FIG. 4). As will be explained more fully below, cutout 29 and upper registration holes 31 and 32 are used for alignment purposes during the installation of each display assembly 11.

The lower, rear side of display assembly 11 includes a control and interconnection panel 25, having a power switch 30 and connection jacks 35. Power, video, and control signals are fed to the connection jacks of the display assembly through a plurality of cables, not shown in the drawings.

A decagonal base plate 33 forms the primary structural support for the array 12. Base plate 33 is provided with a circular center aperture, mentioned above, sized to accommodate at least one person. The circular array 12 of the present invention may be used advantageously in connection with an existing tank training simulator (not shown), in which the old CRT displays are replaced with the display assemblies 11. In such a retrofit application, the existing base plate 33 may have to be tapped or bored with new holes to accommodate a plurality of upwardly extending registration pins 34. Array 12 may also be used in new tank training simulators, in which case holes for the registration pins 34 would be fabricated as part of a newly manufactured base plate 33. It should also be noted that where the array 12 of the present invention is used for other applications, a substitute equivalent support may be used in lieu of base plate 33. For example, a floor or other substrate could be easily substituted.

Figure 2:
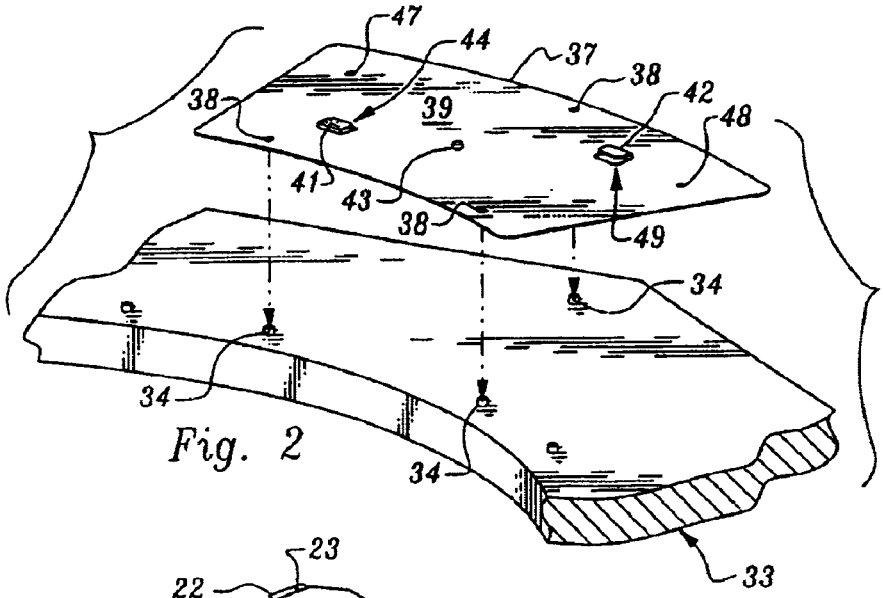
FIG. 2 is an exploded perspective view of a receiver segment and a fragmentary portion of the base plate, showing the three alignment pins.

A circular base ring 36 is assembled to overlay the base plate 33. Ring 36 is comprised of ten arcuate receiver segments 37, with each segment spanning a 36 degree arc. To ensure proper alignment between the receiver segments and the base plate, each receiver segment 37 includes three registration apertures 38. As shown in FIG. 2, the locations of registration apertures 38 correspond the locations of respective underlying registration pins 34. Each receiver segment is successively aligned with and lowered over its set of registration pins. When all ten receiver segments are arranged in lateral edge-abutting relation over base plate 33, the 360 degree base ring 36 is formed (See, FIG. 8).

Each receiver segment 37 is dedicated to the support and proper radial alignment of a respective video display assembly 11. To accomplish that purpose, the upper surface 39 of each receiver segment includes a first locking tab 41 and a second locking tab 42. Locking tabs 41 and 42 are located in spaced relation on either side of a registration pin 43. First locking tab 41 has an entry portion 44 facing in one direction toward the center aperture 13. Second locking tab 42 has an entry portion 46 facing in another direction, away from the center aperture. As is evident from FIG. 2, entry portion 44 and entry portion 46 are oriented in opposite directions.

Lower registration holes 47 and 48 are provided in the left hand and right hand rear portions of receiver segment 37. These lower registration holes are used in the installation of each display assembly and the associated alignment process between the connection plate 21 and the underlying receiver segment 37.

Figure 3:
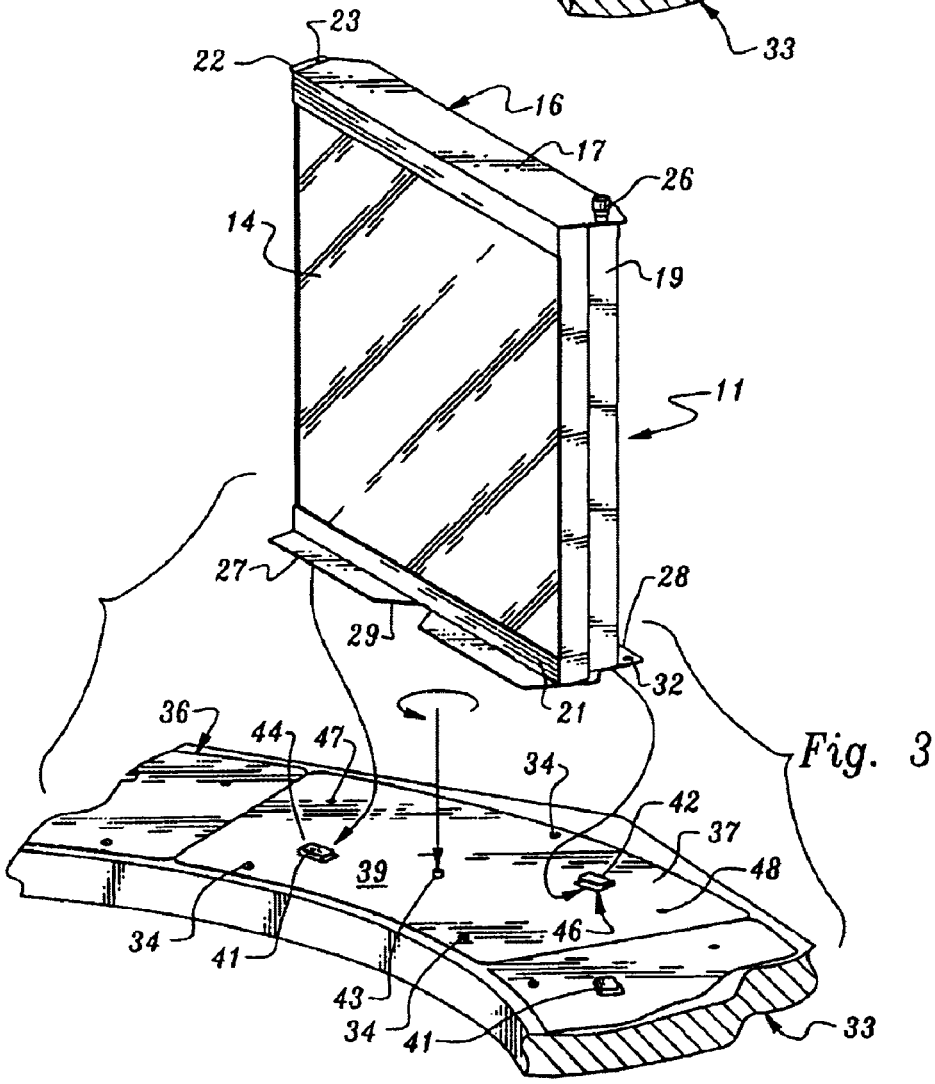
FIG. 3 is an exploded perspective view of a flat panel display assembly being installed on an arcuate receiver segment, illustrating engagement between the flanges on the bottom connecting plate and the locking tabs on the receiver segment.

After the base ring 36 is fully formed, assembly of the circular array 12 can begin. Making particular reference to FIG. 3, a display assembly 11 is lowered into position over a respective receiver segment 37. Assembly 11 is initially oriented with its left hand side toward the rear of ring 36 and its right hand side toward the front of ring 36. Triangular-shaped cutout 29 is aligned with respect to segment 37 so that registration pin 43 is nested within the apex of cutout 29. With connection plate 21 now resting upon the upper surface 39 of segment 37, display 11 is manually rotated in a counter-clockwise fashion about its vertical axis. As rotation of the display assembly 11 about registration pin 43 continues, the front and rear flanges 27 and 28 pass through respective entry portions 44 and 46, and engage tabs 41 and 42.

Figure 5:
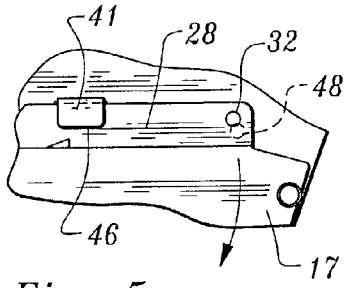
FIG. 5 is a detail inset view of the right hand rear corner of the display assembly in FIG. 4, but showing the upper registration hole in the rear flange out of alignment with the lower registration hole in the receiver segment.
Figure 6:
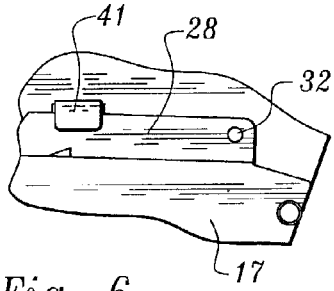
FIG. 6 is a view as in FIG. 5, but showing the upper registration hole and the lower registration hole in alignment, after the display assembly has slightly been rotated in clockwise fashion.

Display assembly 11 must still be counter-rotated, to a slight degree and in a clockwise fashion, to complete the alignment process. Making reference to FIG. 5, it can be seen that the upper registration hole 32 is out of axial alignment with lower registration hole 48. Similarly, on the left hand side of assembly 11, upper registration hole 31 is out of axial alignment with lower registration hole 47. With a slight clockwise rotation of the assembly 11, the upper and lower registration holes become aligned and axially coincident, as shown in FIG. 6.

Figure 9:
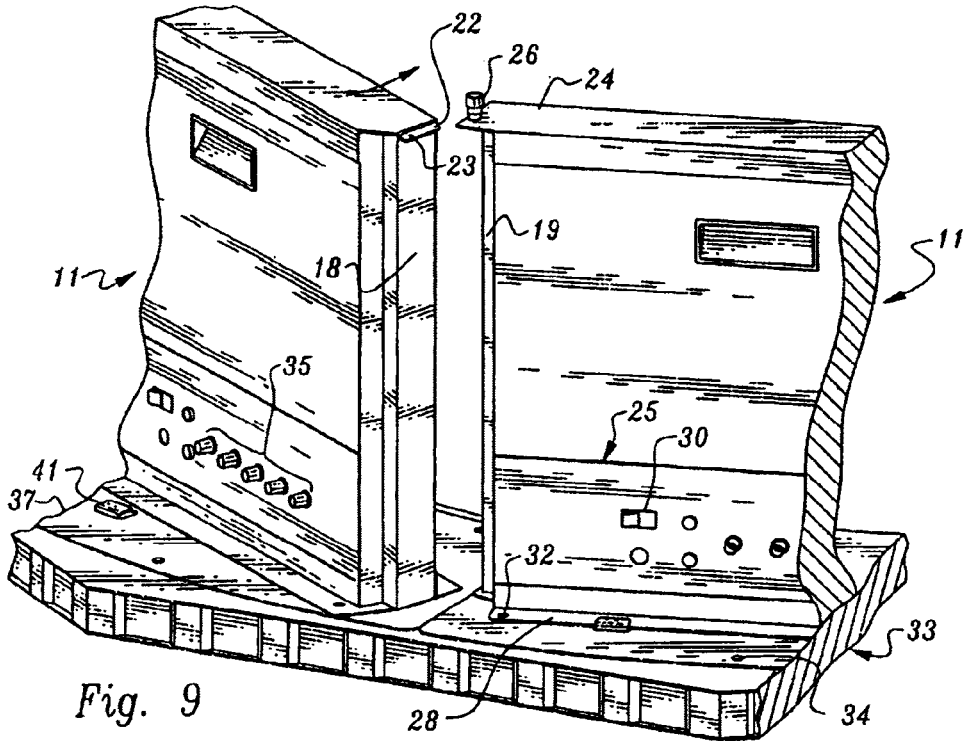
FIG. 9 is a fragmentary perspective view of two display assemblies, the left hand assembly in the process of being rotated about its vertical axis into a locked position; and, FIG. 10 is a view as in FIG. 9, after the left hand display assembly has been rotated into a fully locked position, and after the locking screw in the right hand display assembly has been secured into a threaded hole in the top plate flange of the left hand display assembly.
Figure 10:
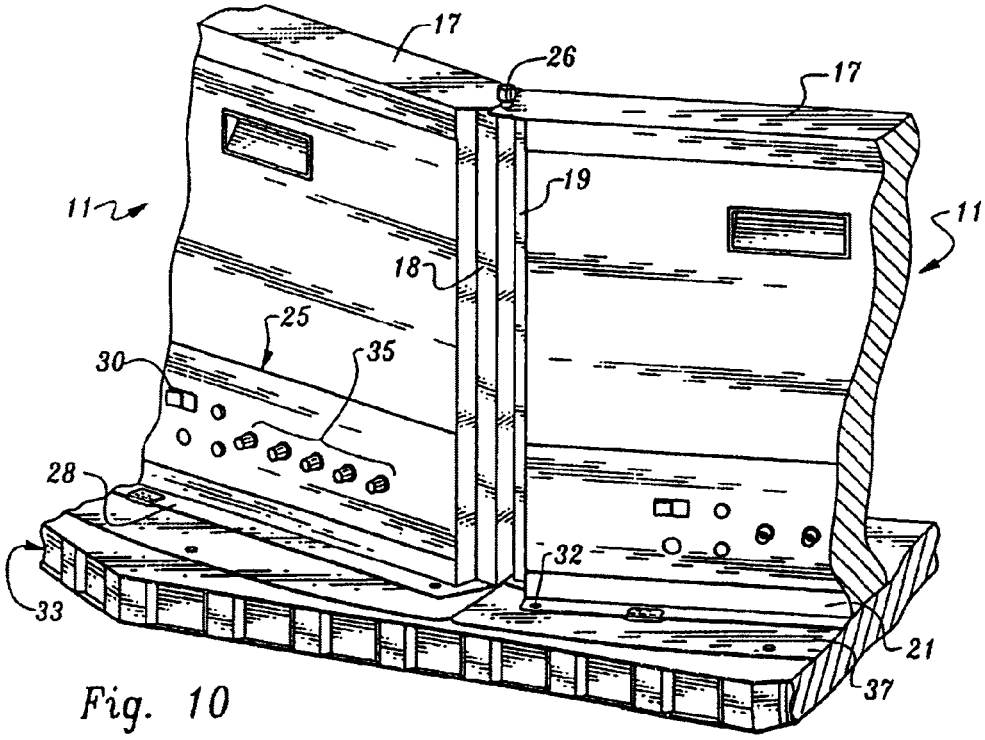

With the installation of a first assembly 11 completed, a second assembly 11 is mounted on an adjacent receiver segment 37, in identical fashion. The installer can proceed with the installation of the next display assembly either to the left or to the right of the first display assembly. However, it is preferred to install successive display assemblies in a clockwise direction. FIG. 9 shows the first assembly already in place, while the second assembly is in the process of being rotated into a locked position. FIG. 10 shows the relative positions of the two assemblies after rotation is completed. Screw 26 in top plate 17 of the first assembly is manually rotated so that it threadably engages screw hole 23 in top plate 17 of the second assembly.

Figure 7:
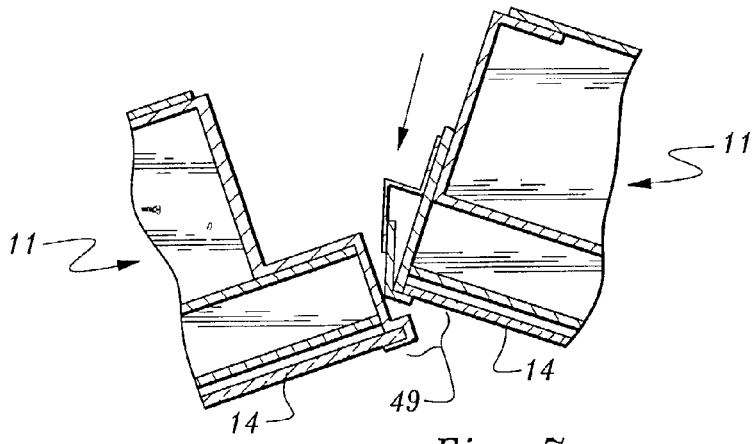
FIG. 7 is a detail view showing the slight side edge overlap between adjacent display assemblies.

As is evident from FIG. 7, when the right hand display assembly is rotated into position adjacent the left hand display assembly, there is a physical overlap 49, between the adjacent side edges of the two assemblies. The purpose of the overlap is to minimize the gap, or visual display dead space, between the two screens. In practice, the gap has been reduced to approximately 0.250", so that the visual continuity between the screens of adjacent display assemblies is quite good. Another way of expressing this overlap is the fact that a perpendicular line from the center of screen 14 does not pass directly through center of the center aperture 13, but is slightly offset therefrom. This slight offset is predetermined by the location of the lower registration apertures 47 and 48 in receiver segment 37.

Figure 8:
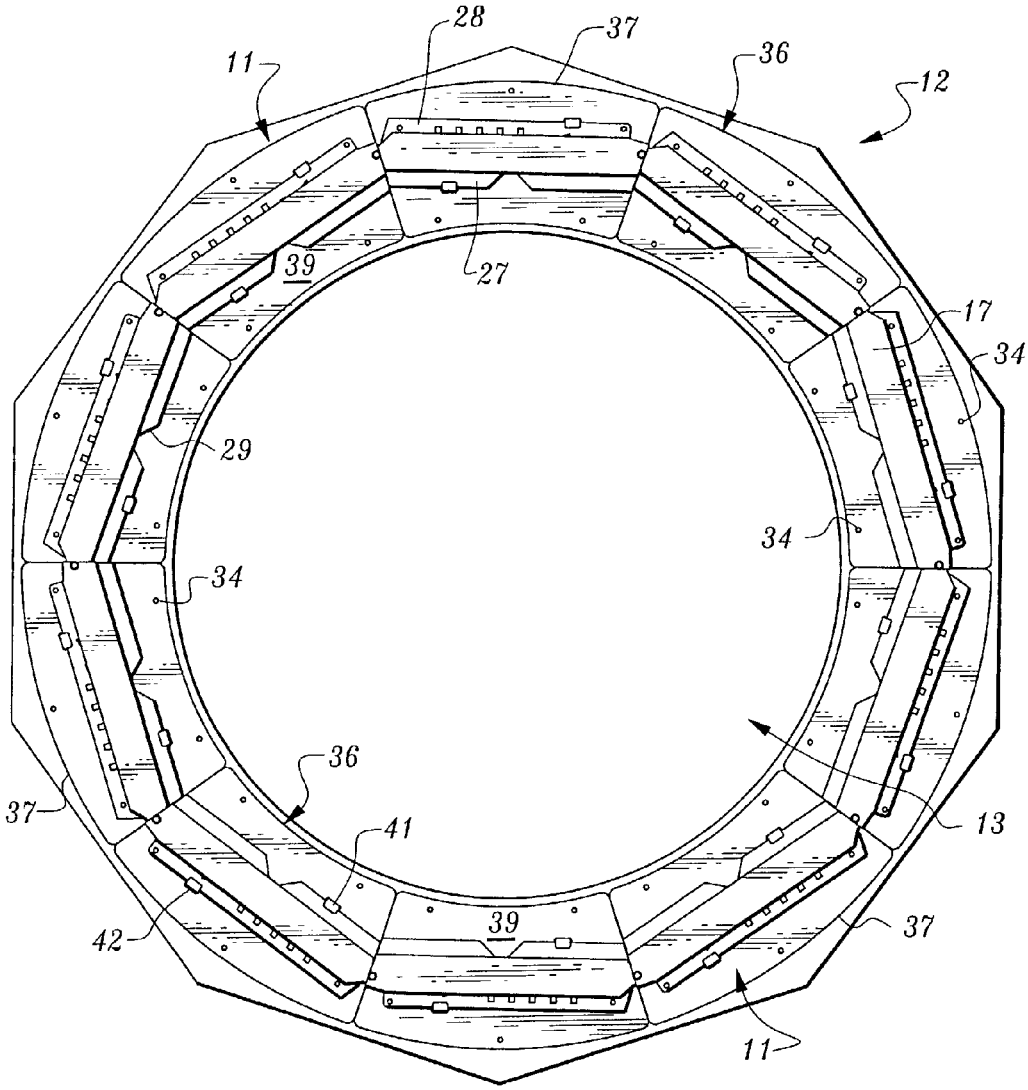
FIG. 8 is a top plan view of the circular array of flat panel display assemblies, showing the entirety of base plate and the fully assembled base ring.

Successive display assemblies 11 are installed until the entire circular array 12 is formed, as shown in FIGS. 1 and 8. Despite the fact that each assembly is "floating", as it is not rigidly affixed to the base ring, the array is quite rigid and stable. This stems from the geometric configuration of the array, the mechanical restraint provided by the connectors between the assemblies, and the mechanical restraint provided by the flange and tab arrangement.

One of the unique advantages provided by the "floating" mounting system, is the avoidance of mechanical multiplication of tolerance deviations. For example, if the assemblies were rigidly attached to the receiver segments, small tolerance deviations from assembly to assembly could build up so that attachment to both the segment and the adjacent assembly would be difficult or impossible. In the apparatus of the present invention, the mechanical interconnection between adjacent display assemblies is effected very quickly and easily, because the flange and tab arrangement allows small movements of the assemblies during interconnection. However, when the display assemblies are all mounted and interconnected, the array is unexpectedly rigid and stable. Another unique advantage provided by the mounting system is the ability, easily and quickly, to remove a single display assembly, for repair or replacement, without disturbing the integrity of the remaining array. Installation of a new or repaired display assembly takes just a few minutes, and requires no special tools or any additional alignment procedure to complete.

What is claimed is:

1. An apparatus for mounting a video display assembly, comprising:

a. a receiver segment having an upper surface provided with first and second locking tabs and a registration pin, said locking tabs being located in spaced relation on either side of said registration pin, said first locking tab having an entry portion facing in one direction, and said second locking tab having an entry portion facing in another direction, opposite from said one direction; and, b. a connection plate having a front flange and a rear flange, said connection plate being mounted to a bottom edge of the video display assembly, said front flange having a cutout, whereby, said connection plate is first lowered onto said upper surface of said receiver segment, with said registration pin being located within said cutout, and said connection plate is then rotated about a vertical axis of the display assembly so that said front flange engages said entry portion of said first locking tab and said rear flange engages said entry portion of said second locking tab, thereby mounting said connection plate to said receiver segment.

2. An apparatus as in claim 1 in which said entry portion of said first locking tab faces toward a front side of said receiver segment, and said entry portion of said second locking tab faces toward a rear side of said receiver segment.

3. An apparatus as in claim 1 in which said receiver segment is arcuate.

4. An apparatus as in claim 3 including a plurality of said arcuate segments arranged to form a base ring, and a plurality of respective connection plates mounted on said arcuate segments.

5. A video display assembly comprising:

a. an active matrix liquid crystal display screen having a top edge, side edges, and a bottom edge;

b. a frame surrounding said screen, said frame including a top plate on said top edge, opposing, vertical side plates on respective said side edges, and a bottom connection plate on said bottom edge, said top plate including a first connector extending from a left hand end thereof, said top plate also including a second connector extending from a right hand end thereof, said bottom connection plate being perpendicular to said screen and including a front flange and a rear flange extending, respectively, forwardly and rearwardly from said screen, and said front flange having a front edge provided with a cutout.

6. A video display assembly as in claim 5 in which said first connector comprises a first flange and a screw hole and said second connector comprises second flange and a threaded screw.

7. A video display assembly as in claim 5 including first and second video display assemblies, in which said first connector of said first assembly is connected to said second connector of said second assembly.

8. A video display assembly as in claim 7 in which a vertical side plate of said first assembly is maintained in adjacent relation with a vertical side plate of said second assembly by said first and second connectors.

9. A video display assembly as in claim 7 in which a vertical side plate of said first assembly is maintained in slightly overlapping relation with a vertical side plate of said second assembly.

10. A video display assembly as in claim 5 including a plurality of said video display assemblies arranged to form a substantially circular array, and in which said first connector of each said assembly is connected to said second connector of an adjacent said assembly.

11. A video display assembly as in claim 10 in which said screens of said display assembly are directed inwardly toward a center of said circular array.

12. A video display assembly as in claim 11 in which said screens are driven with video information which simulates a 360 degree view for a person located in said center of said circular array.

13. A circular video display array, comprising:

a. a base ring including a plurality of arcuate receiver segments, each of said segments having a front edge, a rear edge, and opposing side edges, adjacent ones of said receiver segments being arranged side edge to side edge in abutting relation to form a circle, said segments having an upper surface provided with first and second locking means; and, b. a plurality of flat panel video display assemblies, each of said display assemblies including a flat screen provided with a surrounding frame, said surrounding frame comprised of a top plate, opposing, vertical side plates, and a bottom connection plate, said top plate including a first connection means on a left hand end thereof, and said top plate including a second connection means on a right hand end thereof, said bottom connection plate including a front flange and a rear flange; whereby, each of said display assemblies together with its associated bottom connection plate is sequentially lowered over and rotated into locking engagement with said locking means on a respective receiver segment, and said first connection means of each display assembly is mated to said second connection means of an adjacent display assembly to form a substantially circular display.

14. A display as in claim 13 in which said first connection means comprises a first flange extending outwardly from a left hand end of said top plate and said second connection means comprises a second flange extending from a right hand end of said top plate, said first flange including a screw hole and said second flange including a screw.

15. A display as in claim 13 in which said first and second locking means comprises first and second locking tabs and a registration pin, said locking tabs being located in spaced relation on either side of said registration pin, said first locking tab having an entry portion facing in one direction, and said second locking tab having an entry portion facing in another direction, opposite from said one direction.

16. A video display array as in claim 13 in which said screens of said display assemblies are directed inwardly toward a center of said circular array.

17. A video display array as in claim 13 in which said screens are driven with video information which simulates a 360 degree field of view for a person located in a center of said circular array.

18. A video display array as in claim 13 in which said screens are active matrix liquid crystal display screens.

19. A video display array as in claim 13 in which said base ring is mounted over a base plate, said base plate including a plurality of upwardly extending registration pins corresponding to a predetermined location for each of said receiver segments, and in which each of said receiver segments includes a plurality of registration apertures for receipt of a respective one of said registration pins when said receiver segments are lowered over said base plate.

* * * * *